US006940068B2

(12) United States Patent
Burns et al.

(10) Patent No.: US 6,940,068 B2
(45) Date of Patent: Sep. 6, 2005

(54) QUADRUPOLE MASS FILTER

(75) Inventors: Donald Matthew Burns, Halifax (GB); Stephen Taylor, Liverpool (GB); John Raymond Gibson, Liverpool (GB)

(73) Assignee: Reliance Gear Company Limited (GB)

( * ) Notice: Subject to any disclaimer, the term of this patent is extended or adjusted under 35 U.S.C. 154(b) by 74 days.

(21) Appl. No.: 10/633,206

(22) Filed: Jul. 31, 2003

(65) Prior Publication Data

US 2004/0084617 A1 May 6, 2004

Related U.S. Application Data

(63) Continuation-in-part of application No. 10/322,757, filed on Dec. 19, 2002.

(30) Foreign Application Priority Data

Jan. 3, 2002 (GB) ..... 0200026

(51) Int. Cl.[7] ..... H01J 49/42

(52) U.S. Cl. ..... 250/292; 250/290; 250/281; 250/282; 250/283; 250/286

(58) Field of Search ..... 250/292, 288, 250/282

(56) References Cited

U.S. PATENT DOCUMENTS

| | | | | |
|---|---|---|---|---|
| 3,725,700 A | | 4/1973 | Turner | 250/41.9 |
| 4,214,160 A | * | 7/1980 | Fies et al. | 250/292 |
| 5,089,703 A | * | 2/1992 | Schoen et al. | 250/292 |
| 5,187,365 A | | 2/1993 | Kelley | 250/282 |
| 6,028,308 A | * | 2/2000 | Hager | 250/282 |

FOREIGN PATENT DOCUMENTS

| | | |
|---|---|---|
| JP | 6-325731 | 11/1994 |
| JP | 8-102283 | 4/1996 |

* cited by examiner

*Primary Examiner*—Nikita Wells
*Assistant Examiner*—Zia R. Hashmi
(74) *Attorney, Agent, or Firm*—Sheridan Ross P.C.

(57) ABSTRACT

Apparatus and method to improve the filtering action of a quadrupole mass filter by reducing a precursor fault caused by an asymmetric electrical field between a pair of opposing electrode rods in a y-axis of the quadrupole mass filter. Processing means for processing detector data determine the filtering action of the quadrupole mass filter by checking for a precursor fault. If a precursor fault is detected then power supply control means introduce an AC potential difference across the electrode rods in the y-axis in order to reduce asymmetry in the electrical field in the y-axis.

28 Claims, 12 Drawing Sheets

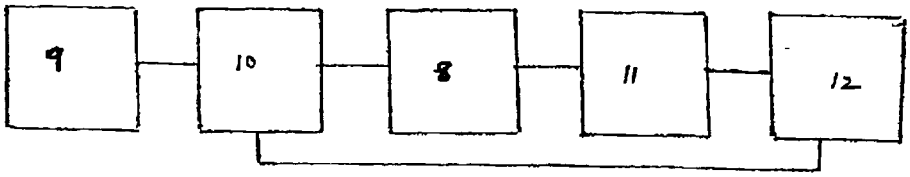
Figure 10A
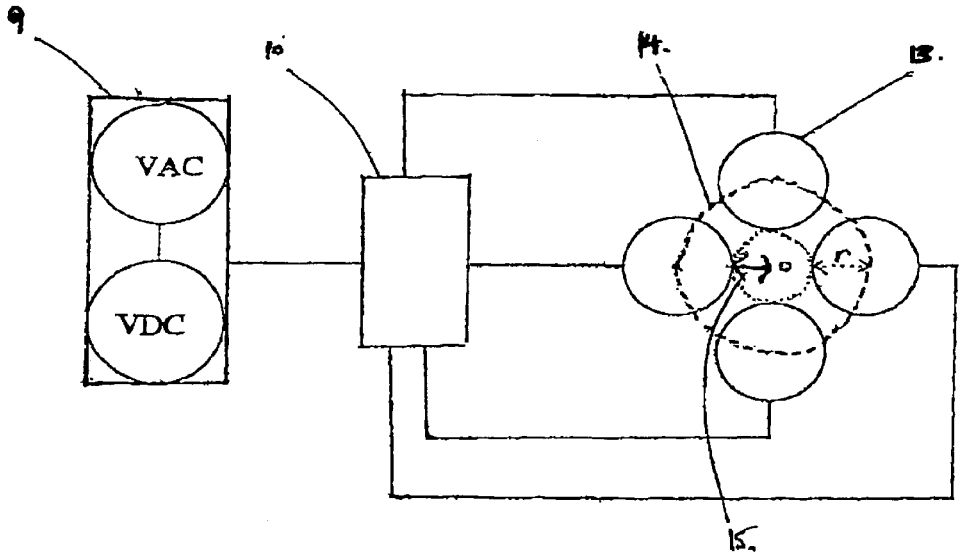
Figure 10B.
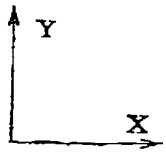
Quadrupole Axis Convention

QUADRUPOLE MASS FILTER

CROSS REFERENCE TO RELATED APPLICATIONS

This application is a continuation in part of and claims priority from pending prior application Ser. No. 10/322,757 entitled "QUADRUPOLE MASS FILTER" filed Dec. 19, 2002.

FIELD OF INVENTION

This invention relates to the filtering action of a quadrupole mass filter (QMF), particularly to improving the filtering action of a QMF by reducing a precursor fault.

BACKGROUND TO INVENTION

Quadrupole mass filters are used as part of a mass spectrometer to analyse the chemical composition of an ionised sample of material. A QMF uses an electrical field to filter the ionised particles according to their mass-to-charge ratios. The electric field is controlled by adjusting the AC and DC voltages so that only ions of a specific mass-to-charge ratio can translate axially through the QMF. The applied voltages have a directly proportional relationship to the mass-to-charge ratio of the transmitted ions, hence the magnitude of the applied AC and DC voltages determines which ions can travel through the QMF. Thus, a perfect QMF will only transmit ions of a particular mass-to-charge ratio when particular AC and DC voltages (nominal voltages) are applied. Unfortunately many QMFs are far from perfect and erroneously transmit ions of a specific mass-to-charge ratio at the wrong AC and DC voltages. A quadrupole mass filter is said to have a precursor fault if it transmits ions of a particular mass-to-charge ratio at voltages that are lower than the nominal AC and DC voltages.

A conventional quadrupole mass filter (1) is depicted in FIG. 1. The QMF includes four electrode rods (2) held in a square parallel array. The electrode rods are arranged as opposing pairs around an origin along an x-axis and a y-axis and they extend substantially parallel to a z-axis (not shown). Each electrode rod has a substantially circular cross-section with a radius r. The electrode rods are positioned on a pitch circle diameter (PCD) (3). The inscribed circle has a radius, $r_0$ (4).

The electrode rods are connected to a combined AC and DC power supply (5). Both an AC and a DC voltage are applied to each electrode. FIG. 1 shows that the pairs of opposing electrodes are electrically connected together. Thus, the opposing electrodes in the x-axis have a common power supply and the opposing electrode rods in the y-axis have a common power supply. Consequently, there is no potential difference across the x-axis electrode rods or across the y-axis electrode rods. An electrical field is generated around each electrode rod when they are excited. In a perfect QMF the electrical fields of each of the four electrode rods combine to create an electric field that approximates to a rectangular hyperbolic electrical field. The effective part of this resulting electrical field is generated in a central void formed within the square array of the electrode rods.

The ions have complex trajectories within the QMF. The QMF filters the ions by using an electric field to control the motion of ions with a specific mass-to-charge ratio. This is achieved by applying AC and DC voltages to the electrode rods so that an electrical field is set-up to stabilise the motion of certain ions in the x and y directions. As mentioned above, the magnitude of the applied voltages is directly proportional to the mass-to-charge ratios of the ions. Consequently, in a perfect QMF, particular AC and DC voltages set-up an electrical field that can only stabilise the motion of ions with a particular mass-to-charge ratio. The electrical field enables the ions of the specific mass-to-charge ratio to oscillate in a stable manner in the x and y-axes whilst moving along the z-axis. As a result, these ions are able to travel through the QMF. Ions with a different mass oscillate in an unstable manner within the QMF. The trajectory of these ions grows until they strike an electrode rod and are lost.

The electrical field in the x-axis stabilises the trajectory of heavier ions, whereas the lighter ions are unaffected by the field and have unstable trajectories. Conversely, the electrical field in the y-axis stabilises the trajectories of lighter ions, whereas the heavier ions are unaffected by the field and have unstable trajectories. Consequently, the combined effect of the electrical fields in both axes determines the band pass mass filtering action of the QMF.

If a QMF has a precursor fault then the ions that should have unstable trajectories in the y-axis have, in fact, stable trajectories. Accordingly, they are able to travel through the QMF.

When positive ions are analysed, a positive DC potential is applied to the electrode rods in the x-axis and a negative DC potential is applied to the electrode rods in the y-axis. When negative ions are analysed, a negative DC potential is applied to the electrode rods in the x-axis and a positive DC potential is applied to the electrode rods in the y-axis.

A detector (not shown) is arranged to detect the transmitted ions as they exit the QMF. The detector is electrically connected to a data processing means (not shown) to generate a mass spectrum of the transmitted ions and display means (not shown) to display the mass spectrum. A mass spectrum indicates the ions that are transmitted as different AC and DC voltages are applied. The data processing means and display means are typically provided by a personal computer. The mass spectrum is usually displayed in graphical form.

A QMF may be used as part of a mass spectrometer to determine the different components of an ionised sample of material. This is achieved by varying the applied AC and DC voltages so that ions of many different mass-to-charge ratios can be sequentially detected. A QMF usually increases the voltages so that it scans up the ion mass-to-charge ratio scale. The detected ions are indicative of the composition of the sample of material.

FIG. 2 depicts a mass spectrum of perfluorotributylamine (PFTBA) which has been analysed using a QMF with a precursor fault. The sample of ionised PFTBA is analysed to detect ions with a mass-to-charge ratio of 69 Da. The presence of these ions is indicated in a parent peak (6). If the QMF were perfect, then the mass spectrum would only include the parent peak. However, FIG. 2 shows that the mass spectrum includes a precursor peak (7). The precursor peak indicates that ions with a mass-to-charge ratio of 69 Da have been erroneously transmitted at lower than nominal voltages.

The most common type of fault in a QMF is a precursor fault.

Precursor faults are extremely problematic because they affect the filtering action of the QMF. Consequently, a QMF with a precursor fault cannot be relied upon to provide an accurate analysis of the chemical composition of an ionised sample of material.

Quadrupole mass filters are very difficult to build. The manufacturing process is time consuming, expensive and requires precision engineering. Hence, the chances of incurring a precursor fault during the manufacturing process are high.

Up until now, the only way of dealing with a precursor fault is to strip, clean and rebuild a QMF. This is both time consuming, expensive and, again, requires precision engineering. Furthermore, there is no guarantee of success. As indicated above, it is very difficult to ensure the electrode rods are perfectly aligned and clean.

QMFs are often required to work at high resolutions. The resolution of the QMF, its ability to distinguish between adjacent ion masses, is set by controlling the U/V ratio. The precursor fault becomes increasingly apparent as the QMF scans up the mass-to-charge ratio scale. Thus, when a QMF with a precursor fault operates at a high resolution the filtering action is inaccurate.

STATEMENTS OF INVENTION

According to the first aspect of the invention, there is provided apparatus to improve the filtering action of a quadrupole mass filter by reducing a precursor fault caused by an asymmetric electrical field between a pair of opposing electrode rods in a y-axis of the quadrupole mass filter, the apparatus comprising processing means for processing detector data to determine the filtering action of the quadrupole mass filter by checking for a precursor fault; and power supply control means to introduce an AC potential difference across the electrode rods in the y-axis, if a precursor fault is detected, in order to reduce asymmetry in the electrical field in the y-axis.

Preferably the power supply control means comprises a potential divider to introduce an AC potential difference across the electrode rods in the y-axis. The power supply control means may comprise means to manually control the potential divider or electronically control the potential divider.

Alternatively, the power supply control means comprises means to supply power separately to each electrode rod in the y-axis to introduce an AC potential difference across the electrode rods in the y-axis. The power supply control means may comprise means to manually control the means to supply power separately to each electrode rod in the y-axis or electronically control the means to supply power separately to each electrode rod in the y-axis.

Preferably, the processing means comprises means to determine the cause of the precursor fault.

Preferably the processing means comprises means to determine the AC potential difference required to reduce asymmetry in the electrical field in the y-axis. The processing means may comprise means to determine the AC potential differences required to reduce asymmetry in the electrical field in the y-axis as the QMF scans across an ion mass-to-charge ratio scale when the precursor fault is due to mechanical misalignment or both mechanical misalignment and surface charge imbalance between the y-axis electrode rods. The processing means may comprise means to determine the AC potential difference required to reduce asymmetry in the electrical field in the y-axis as the QMF scans across an ion mass-to-charge ratio scale when the precursor fault is due to a surface charge imbalance between the y-axis electrode rods.

Alternatively, the power supply control means comprise means to determine the AC potential difference required to reduce asymmetry in the electrical field in the y-axis. In this case, the power supply control means may comprise means to determine the AC potential differences required to reduce asymmetry in the electrical field in the y-axis as the QMF scans across an ion mass-to-charge ratio scale when the precursor fault is due to mechanical misalignment or both mechanical misalignment and surface charge imbalance between the y-axis electrode rods. The power supply control means may comprise means to determine the AC potential difference required to reduce asymmetry in the electrical field in the y-axis as the QMF scans across an ion mass-to-charge ratio scale when the precursor fault is due to a surface charge imbalance between the y-axis electrode rods.

Preferably the power supply control means comprises means to introduce an AC potential difference across the electrode rods in the y-axis to reduce asymmetry in the electrical field in the y-axis whenever the QMF is in operation.

In some preferred embodiments, the only potential difference applied across the y-axis electrode rods is an AC potential difference.

However, in some other preferred embodiments, the power supply control means additionally comprises means to introduce a DC potential difference across the electrode rods in the y-axis. The means to introduce a DC potential difference may comprise means to supply power separately to each electrode rod in the y-axis or a potential divider. Alternatively, the means to supply power separately to each electrode rod in the y-axis to introduce an AC potential difference may be adapted to introduce a DC potential difference across the electrode rods in the y-axis.

Preferably the power supply control means comprises means to supply power separately to each electrode rod in a pair of opposing electrode rods in an x-axis.

According to a second aspect of the invention there is provided a mass spectrometer incorporating the apparatus of the first aspect of the present invention.

According to a third aspect of the invention there is provide a method of improving the filtering action of a quadrupole mass filter by reducing a precursor fault caused by an asymmetric electric field between a pair of opposing electrode in a y-axis, comprising the steps of determining the filtering action of the quadrupole mass filter by checking for a precursor fault; and if a precursor fault is detected, introducing an AC potential difference across the electrode rods in the y-axis in order to reduce asymmetry in the electrical field.

Preferably the method further comprises the step of introducing an AC potential difference by changing the applied AC voltage at one electrode rod in the y-axis. Alternatively, the method further comprises the step of introducing an AC potential difference by changing the applied AC voltage at both electrode rods in the y-axis.

Preferably the method further comprises the step of determining the cause of the precursor fault.

Preferably the method further comprises the step of determining the AC potential difference required to correct asymmetry in the electrical field in the y-axis.

Preferably the method further comprises the step of introducing an AC potential difference across the electrode rods in the y-axis whenever the QMF is in operation.

In some preferred embodiments, the only potential difference applied across the y-axis electrode rods is an AC potential difference.

However, in some other preferred embodiments, the method further comprises the step of introducing a DC potential difference across the electrode rods in the y-axis.

Preferably the method further comprises the step of supplying power separately to each electrode rod in a pair of opposing electrode rods in an x-axis.

Preferably the method further comprises the step of using the apparatus of the present invention.

The method and apparatus of embodiments of the present invention seek at least to reduce or remove, to some extent, the precursor fault. In particularly preferred embodiments, the precursor fault is substantially minimised or even eliminated completely. The reduction of the precursor fault is a result of reducing or even minimising or eliminating any asymmetry in the electrical field.

Embodiments of the present invention enable a QMF to provide a more accurate analysis of the chemical composition of the ionised sample of material. Furthermore, embodiments of the present invention seek substantially to counteract the problems and risks associated with manufacturing a QMF. Embodiments of the present invention seek to provide a way of reducing a precursor fault without having to strip, clean and rebuild the QMF. Embodiments of the present invention also seek to enable the QMF to work more accurately at high resolutions.

BRIEF DESCRIPTION OF DRAWINGS

For a better understanding of the present invention and to show how it may be carried into effect, reference shall now be made by way of example to the accompanying drawings, in which:

FIG. 10A depicts a simplistic schematic overview of the components of an alternative arrangement of the second embodiment of the invention;

FIG. 10B depicts how the electrode rods are electrically connected to the power supply and power supply control means in the alternative arrangement of the second embodiment of the invention;

DETAILED DESCRIPTION OF THE INVENTION

It has been found that a precursor fault is caused by asymmetry in the electrical field in the y-axis of a QMF. If a QMF suffers from a precursor fault, then the electrical field generated within the central void is asymmetric.

The electrical field asymmetry is caused by mechanical misalignment of one or both y-axis electrode rods and/or surface charge imbalance between the electrode rods in the y-axis.

Figure 1:
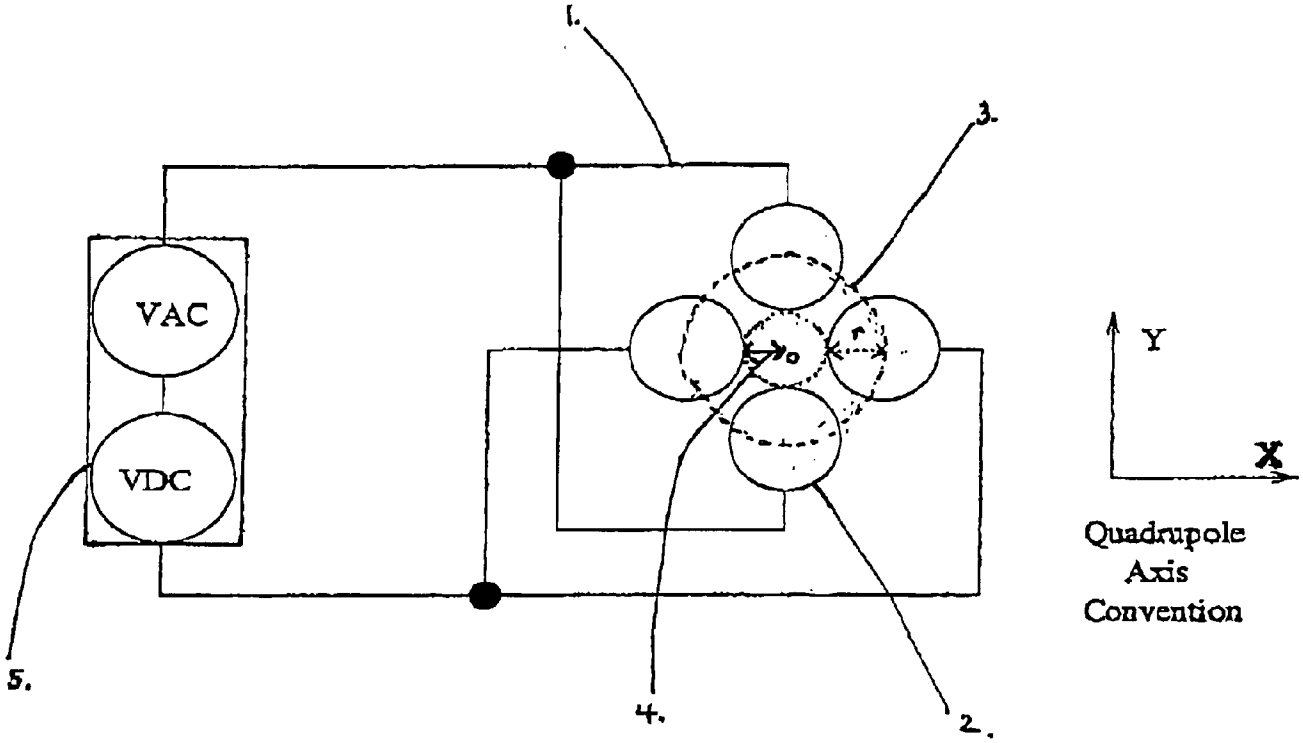
FIG. 1 depicts a cross-sectional view of a conventional quadrupole mass filter.
Figure 2:
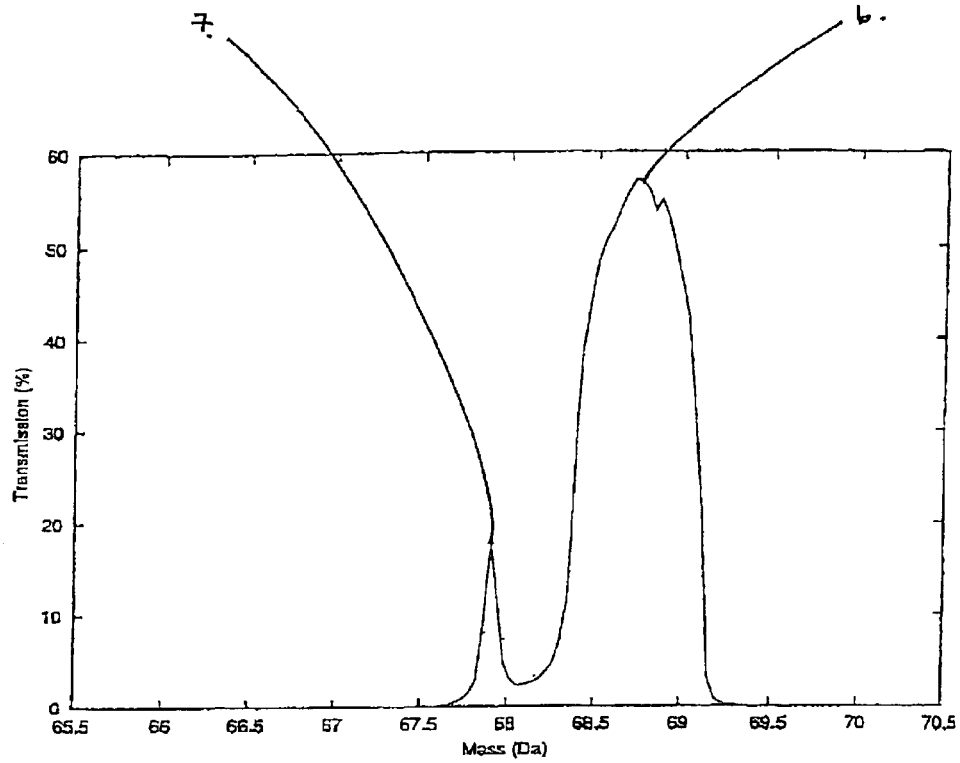
FIG. 2 depicts a mass spectrum graph of fragment 69 Da of PFTBA using a conventional quadrupole mass filter with a precursor fault.

A precursor fault will occur if an electrode rod is misaligned by even a very small distance, for example 1 $\mu$m. An electrode rod may be radially offset or displaced tangentially to the pitch circle diameter on which the electrode rods are positioned. The QMF used to analyse PFTBA in FIG. 2 suffers from a precursor fault due to mechanical misalignment. In this case, a y-axis electrode rod is radially offset having moved 0.01 mm towards the centre of the QMF.

A precursor fault may occur if the surface of one or both of the y-axis electrode rods are contaminated or deteriorates since a surface charge imbalance is created.

The present invention improves the filtering action of a QMF by reducing the precursor fault. The precursor fault is reduced when asymmetry in the y-axis electrical field is reduced (corrected). The precursor fault is minimised when asymmetry in the electrical field is minimised (corrected in-part). The precursor fault is eliminated when asymmetry in the electrical field in the y-axis is eliminated (completely corrected).

Asymmetry in the y-axis electrical field is reduced by applying an AC potential difference across the y-axis electrode rods. The AC potential difference is created by controlling the AC voltage applied to the electrode rods in the y-axis. The apparatus to improve the filtering action of the QMF includes power supply control means to control the AC and DC power supplied to the electrode rods. The power supply control means particularly controls the AC voltage applied to one or both electrode rods in the y-axis such that an AC potential difference is set up. By changing the relative AC potential at one or both of the electrode rods in the y-axis the asymmetrical electrical field is corrected. The power supply control means may be resistive, inductive or capacitive.

Asymmetry caused by a surface charge imbalance may be further reduced by applying a DC potential difference across the y-axis electrode rods. The DC potential difference may be created by controlling the DC potential applied to the electrode rods. A DC potential difference may be applied to help further reduce a precursor fault. Residual asymmetry is present in the y-axis electrical field if it has not been entirely corrected by the application of the AC potential difference. The DC potential difference may be applied to reduce residual asymmetry in the y-axis.

The definition of the x and y-axes follows the normal conventions for a QMF. When a QMF is used to analyse positive ions, the electrode rods in the x-axis have a positive DC potential and the y-axis electrode rods have a negative DC potential. When a QMF is used to analyse negative ions, the electrode rods in the x-axis have a negative DC potential and the electrode rods in the y-axis have a positive DC potential.

Ideally, the electrode rods of the QMF ideally have a hyperbolic profile. Alternatively, the electrode rods are shaped such that when they are all excited a resultant electrical field that approximates to a rectangular hyperbolic electrical field is created. The electrode rods may have a circular cross-section.

In a first embodiment of the invention, the power supply control means includes a potential divider to create an AC potential difference by adjusting the AC voltage applied to both electrode rods in the y-axis. A potential divider such as a potentiometer may be used to adjust the AC voltages. Alternatively, in a second embodiment of the invention the power supply control means include means to supply power separately to each y-axis electrode rod so that they can be excited individually. When the y-axis electrode rods are excited by different AC voltages an AC potential difference is set-up. The power supply control means may increase or decrease the voltage applied to one or both of the electrode rods to achieve the required potential difference. Optionally, the power supply control means may include means to control the DC voltage applied to the electrode rods and introduce a DC potential difference across the y-axis. Furthermore, the power supply control means may also include means to separately supply power to each x-axis electrode rod. Thus, the electrode rods in both the x-axis and y-axis can be excited individually. In a third embodiment of the invention the power supply means include both a potential divider and means to supply power separately to each electrode rod in the y-axis. The potential divider may be used to introduce an AC potential difference, whilst the individual power supply means may introduce a DC potential difference across the y-axis. Conversely, the potential divider may be used to introduce a DC potential difference, whilst the individual power supply means may introduce an AC potential difference across the y-axis.

The potential difference required to correct the electrical field imbalance is dependent upon the distance of separation from the precursor peak to the parent peak. There is a directly proportional relationship between the distance of separation between the peaks and the size of potential difference.

Figure 3:
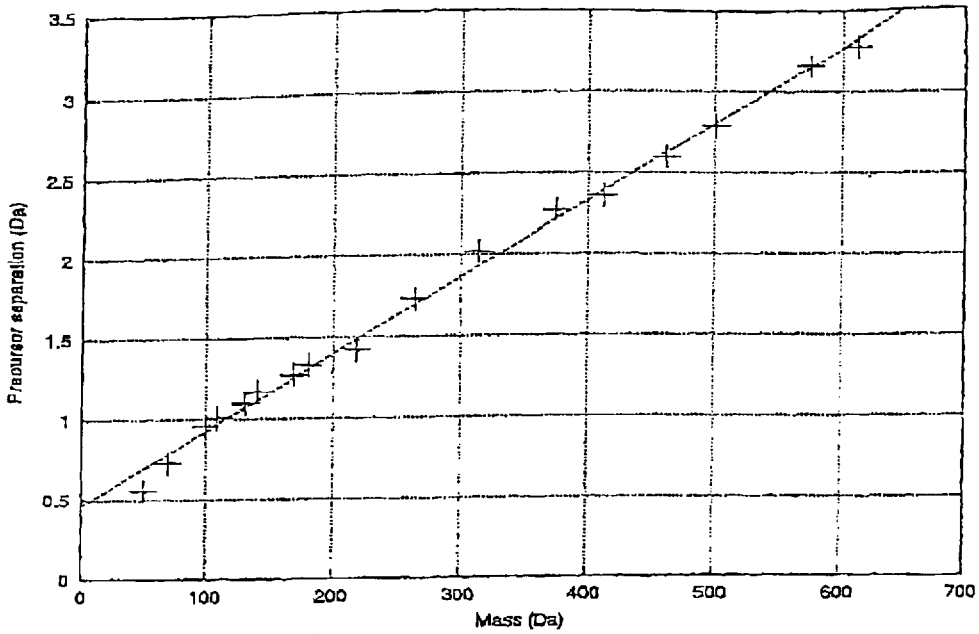
FIG. 3 depicts a graph showing how the distance of separation relates to the specific ion mass-to-charge ratios when an ionised sample of PFTBA is analysed using a quadrupole mass filter with mechanical misalignment in the y-axis.

When asymmetry in the electrical field is caused by mechanical misalignment, the distance of separation between the precursor peak and the parent peak is directly proportional to the mass-to-charge ratio of the specified ion. The graph shown in FIG. 3 relates to the scanning of ionised PFTBA for ions with different specific mass-to-charge ratios. The sample of ionised PFTBA is analysed using a QMF with a y-axis electrode rod that is radially offset by 78 $\mu$m. FIG. 3 depicts the direct relationship between the ion mass-to-charge ratio and the distance of separation between the parent peak and precursor peak. As the mass-to-charge ratio of the ions increases the distance of separation increases. Since the potential difference required to rebalance the electrical field is directly proportional to the distance of separation between the mass spectrum peaks, the potential difference is also directly proportional to the specific ion mass-to-charge ratio. Thus, as the QMF scans for ions up the mass-to-charge ratio scale, the AC potential difference required to reduce the precursor fault increases. Furthermore, since the mass-to-charge ratio is directly proportional to the applied AC and DC voltages, the potential difference required to the correct the asymmetric electrical field is also directly proportional to the applied AC and DC voltages.

Figure 4:
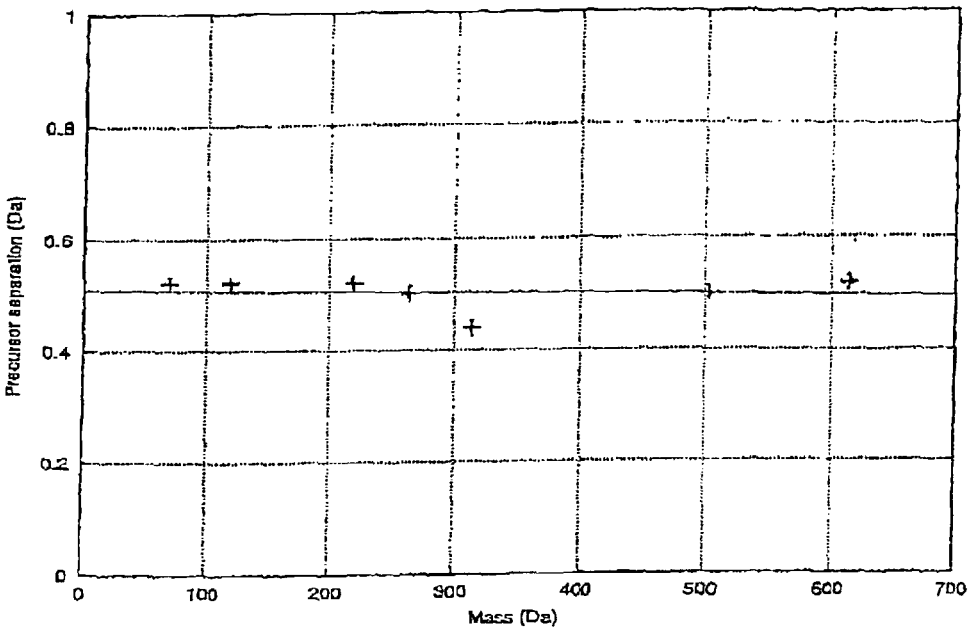
FIG. 4 depicts a graph showing how the distance of separation relates to the specific ion mass-to-charge ratios when an ionised sample of PFTBA is analysed using a quadrupole mass filter with a surface charge imbalance between the electrode rods in the y-axis.
Figure 5:
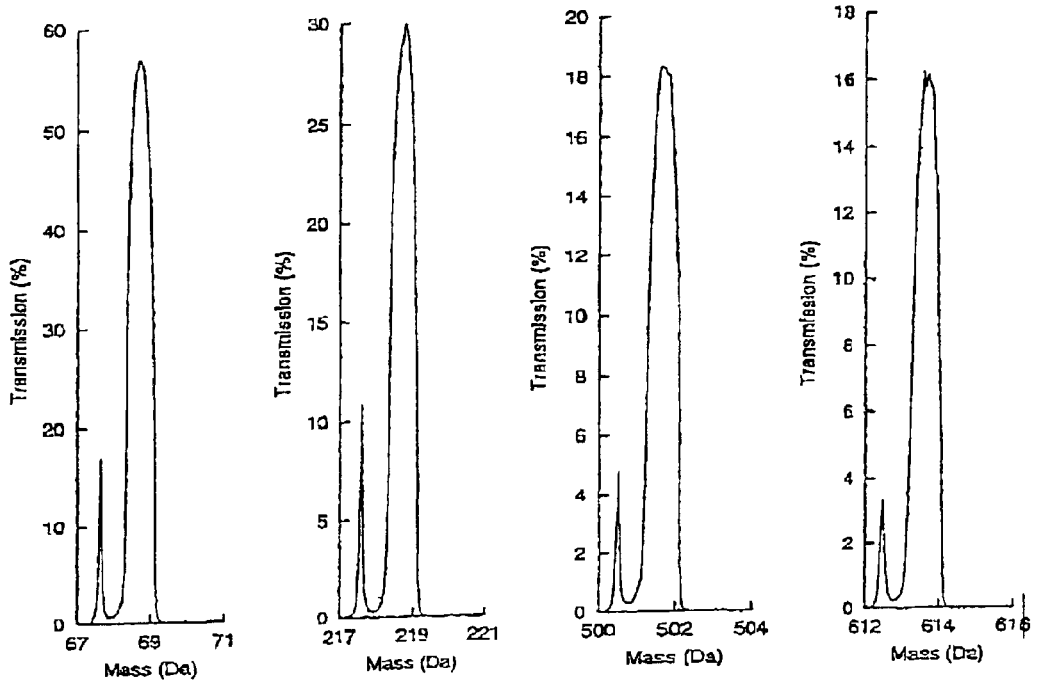
FIG. 5 depicts four mass spectrum fragment graphs of PFTBA for four different specific ion mass-to-charge ratios when an ionised sample of PFTBA is analysed using a quadrupole mass filter with a surface charge imbalance between the electrode rods in the y-axis.

When the precursor fault is caused by surface charge imbalance the distance of separation between the precursor peak and the parent peak is indifferent to the mass-to-charge ratio of the specific ion. This feature is clearly identified in FIG. 4. The graph shown in FIG. 4 relates to the scanning of ionised PFTBA for ions with different mass-to-charge ratios using a QMF where a y-axis electrode rod has been heavily oxidised in an alkaline cleaning solution. FIG. 4 shows that the distance of separation between the parent peak and precursor peak does not vary substantially with ion mass-to-charge ratios. Thus, the potential difference required to reduce the precursor fault by reducing asymmetry in the electrical field is not dependent on the mass-to-charge ratios of the scanned ions, nor the applied AC and DC voltages FIG. 5 depicts four mass spectrums fragment graphs for PFTBA. In this case a QMF with a surface charge imbalance between the y-axis electrode rods is used to analyse ions with a mass-to-charge ratio of 69 Da, 219 Da, 502 Da and 614 Da. The mass spectrum graphs clearly shows that the distance of separation remains a constant as PFTBA is scanned for ions with different mass-to-charge ratios. Thus, when the precursor fault is due to a surface charge imbalance, the potential difference required to reduce asymmetry in the electrical field is always a constant value. As the QMF scans for ions up the mass-to-charge scale the potential difference required to eliminate the precursor fault remains the same. A potential difference of 200 mV was required to reduce the precursor fault in the QMF used in FIG. 5.

A QMF is tested when it is initially integrated as part of a mass spectrometer. The filtering action of the QMF is determined by scanning a sample of material for ions with a range of low and high mass-to-charge ratios. If a precursor fault is detected then an AC potential difference is applied to reduce asymmetry in the y-axis electrical field. The AC potential difference may be applied by manually adjusting the AC potentials at one or both of the electrode rods. Alternatively, the AC potential difference may be electronically calculated and applied. The QMF is monitored to check that the application of the AC potential difference reduces the precursor fault and improves the filtering action. The sensitivity of the QMF is also checked; its degree of transmission. The resolution of the QMF is checked to ensure that it is above the required minimum as specified by the mass spectrometer.

Embodiments of the present invention include processing means to determine the filtering action of the QMF. The processing means is electrically connected to a conventional detector. The processing means may be a personal computer with a display monitor. The detector detects the transmitted ions as they exit the QMF and sends this information as an electronic signal onto the processing means. The processing means analyses the data from the detector. The detection processing means may generate a mass spectrum to depict the filtering action of the QMF. The processing means may display the mass spectrum graphically. The processing means may compute the data to detect a precursor fault in the QMF as it receives the data from the detector. Alternatively, the processing means may electronically detect a precursor fault from the mass spectrum. Or, the graph may be analysed manually to determine the filtering action by checking for precursor peaks. A precursor fault will be immediately apparent from the graph.

The cause of the precursor fault can be determined from the mass spectrum. The mass spectrum may be examined manually or electronically to determine if the precursor fault is caused by mechanical misalignment, surface charge imbalance or both.

The power supply control means may include means to manually control the AC voltage applied to one or both of the y-axis electrode rods in order to introduce an AC potential difference. If the QMF has a precursor fault then the AC voltage applied to the electrode rods on the y-axis may be manually adjusted until a sufficient AC potential difference is set-up across the y-axis to correct the asymmetrical electrical field and so reduce the precursor fault. The processing means may work in conjunction with the power supply control means so that the suppression and eventual elimination of the precursor fault can be monitored by watching the precursor peak blend into the parent peak on the mass spectrum graph. If the asymmetrical field is corrected in-part then the precursor peak blends in-part into the parent peak. If the asymmetrical field is entirely corrected then the precursor peak disappears because it blends completely into the parent peak.

Alternatively, the power supply control means may include means to electronically control the AC voltages applied to one or both of the y-axis electrode rods in order to introduce an AC potential difference. If the QMF has a precursor fault then the AC voltages may be varied electronically until a sufficient AC potential difference is set-up across the y-axis to correct the asymmetric electrical field. The processing means may work in conjunction with the power supply control means so that the AC voltages are no longer adjusted (i.e. the AC potential difference has reached its optimum value) when the processing means electronically detects the optimum minimisation/elimination of the precursor fault.

The processing means may include electronic means to calculate the AC potential difference required to reduce the precursor fault.

If the processing means determines that the precursor fault is only caused by mechanical misalignment then it may calculate the required AC potential differences in accordance with the applied AC and DC voltage values. Consequently, an electronic signal indicative of the required potential differences may be sent from the processing means to the power supply control means so that it can electronically manipulate the AC potentials at one or both of the y-axis electrodes and correct the asymmetric electrical field. Alternatively, a signal indicative of the cause of the precursor fault may be sent by the processing means to the power supply control means so that it can electronically determine and apply the required potential differences.

The processing means may calculate the AC potential differences in accordance with the distance of separation between the precursor peak and parent peak. The processing means may include electronic means to measure the distance of separation between the parent peak and precursor peak of the mass spectrum. This method of calculating the required AC potential difference will work if the precursor fault is caused by mechanical misalignment, surface charge imbalance or both. The processing means may calculate the potential differences required to correct the electric field and send this information as an electronic signal to the power supply control means. Alternatively, an electronic signal, indicative of the distance of separation, may be sent from the processing means to the power supply control means so that it can calculate and apply the required potential difference.

If the QMF is found to have a precursor fault then an AC potential difference is applied across the y-axis electrode rods whenever the QMF is in operation. The potential difference varies if the precursor fault is caused by mechanical misalignment. Thus, as the QMF scans up the mass-to-charge ratio scale the potential difference required to correct the asymmetrical electrical field in the y-axis increases. The potential difference is a constant value if the precursor fault is caused by a surface charge imbalance. Thus, as the QMF scans up the mass-to-charge ratio scale the potential difference required remains the same. The potential difference also varies proportionally to the mass-to-charge ratio scale if the precursor fault if caused by both mechanical misalignment and surface charge imbalance.

The AC potential difference values required to correct the precursor fault in the QMF may be calculated and stored in a memory when it is initially tested. Alternatively, the AC potential difference values may be calculated and may be stored in a memory when the QMF is in operation. The processing means or power supply control means may include a memory to store the required AC potential difference values.

As explained above, a DC potential difference may be optionally applied across the y-axis electrode rods to further reduce asymmetry in the electrical field. The DC potential difference only has an effect on asymmetry caused by surface charge imbalance between the y-axis electrode rods. The DC potential difference is only applied if the processing means detects that precursor fault is caused, or caused in part by a surface charge imbalance and/or if the processing means detect the AC potential difference has failed to entirely correct the asymmetrical electrical field. The DC potential difference may be applied manually or electronically calculated and applied using a potential divider or means to supply power separately to the electrode rods. The DC potential difference values may be calculated and stored in the memory when the QMF is initially tested or in operation.

Figure 6A:
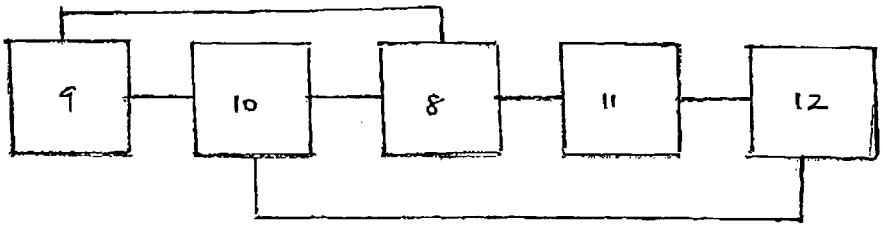
FIG. 6A depicts a simplistic schematic overview of the components of the first embodiment of the present invention.
Figure 6B:
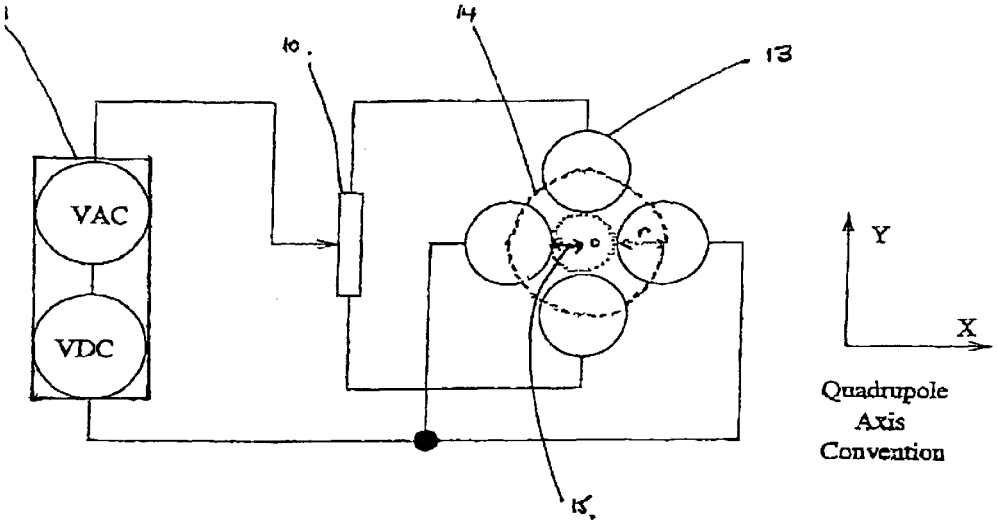
FIG. 6B depicts how the electrode rods are electrically connected to the power supply and power supply control means in the first embodiment of the present invention.

FIGS. 6A and 6B depict the first embodiment of the invention to improve the filtering action of a quadrupole mass filter. FIG. 6A depicts a QMF (8), AC and DC power supply (9), power supply control means (10), detector (11) and processing means (12). FIG. 6B depicts how the electrode rods (13) of the QMF are electrically connected to the power supply and power supply control means.

As with a conventional QMF, the QMF of the present invention includes four electrode rods (13) held in a square parallel array. Discs or collars (not shown) support the electrode rods. The discs or collars may be formed from a ceramic material or Polyetheretherketone (PEEK). The electrode rods are arranged as opposing pairs around an origin along an x-axis and an y-axis and they extend substantially parallel to a z-axis (not shown). The electrode rods are positioned on a pitch circle diameter (PCD) (14). The inscribed circle has a radius $r_0$ (15). The electrode rods have a substantially circular cross-section with radius r.

The electrodes are connected to an AC and DC power supply (9). An electrical field is generated around each electrode rod when they are excited. The electrical fields of each of the four electrode rods combine to create an electrical field. If the QMF is perfect then the electrical field closely resembles a rectangular hyperbolic electrical field. However, if the QMF suffers from a precursor fault then the electrical field is asymmetric and so does not as closely resemble a rectangular hyperbolic electrical field. The effective part of this resulting electrical field is generated in a central void formed within the square array of the electrode rods.

The x-axis electrode rods are directly connected to the AC and DC power supply (9). They are electrically connected together so that they have a common power supply. Thus, no potential difference is set up across the x-axis electrode rods when an AC and DC voltage is applied. The y-axis electrode rods are indirectly connected to the AC and DC power supply via a power supply control means (10). The power supply control means includes a potential divider. The potential divider is arranged between the AC and DC power supply and the y-axis electrode rods so that it can manipulate the AC voltage applied to both electrode rods. If the QMF suffers from precursor fault then the potential divider changes the relative AC potentials at each y-axis electrode rod so that an AC potential difference is created. The DC voltages applied to the y-axis electrode rods remains unchanged.

The detector (11) is arranged to detect the transmitted ions as they exit the QMF. The detector sends an electronic signal, indicative of the results, to the detection processing means (12). The processing means is a personal computer with a display monitor. The processing means determines the filtering action of the QMF by analysing the data. The processing means produce a mass spectrum. This is displayed graphically on the display monitor. In this particular embodiment, the filtering action of the QMF is determined manually by studying the graph to check for precursor peaks.

The power supply control means includes means to manually control the AC voltage to both electrode rods in the y-axis (not shown). In this case, the means to manually control the AC voltage adjust the potential divider. As explained above, the processing means work in conjunction with the power supply control means to ensure that the asymmetric field is corrected to reduce the precursor fault. As the asymmetric electrical field is corrected the precursor peak blends into the parent peak of the mass spectrum graph.

The U/V ratio of the DC and AC power supply is controlled to ensure that the QMF operates at the required resolution high resolution.

Figure 7:
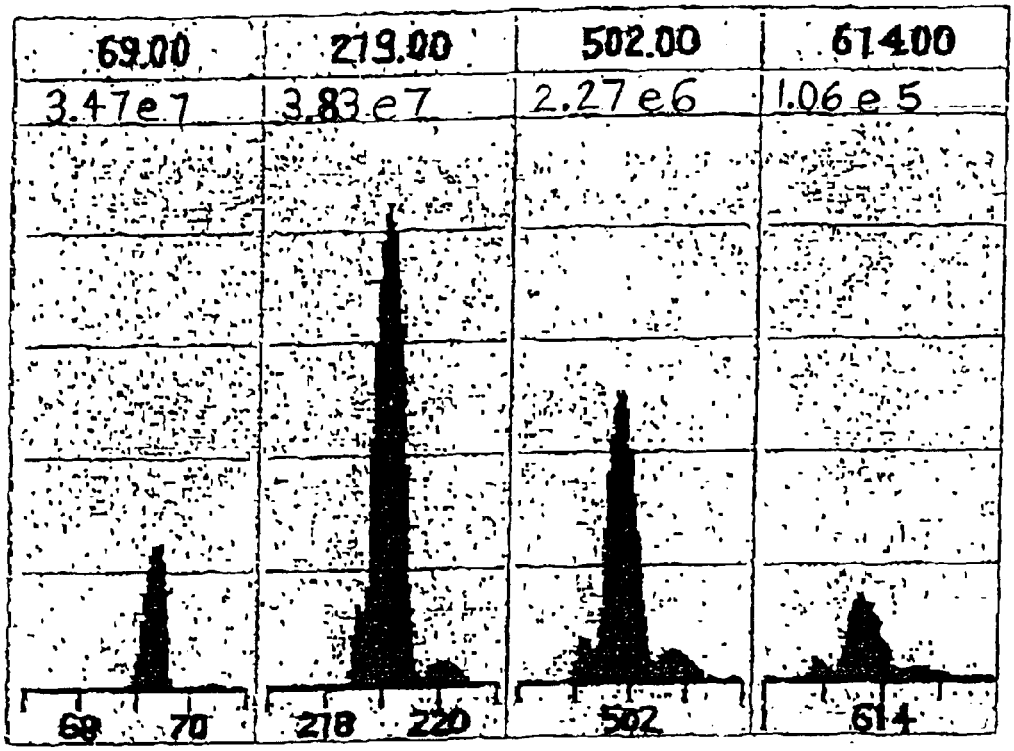
FIG. 7 depicts four mass spectrum fragment graphs of PFTBA for four ions with different mass-to-charge ratios when an ionised sample of PFTBA is analysed using the quadrupole mass filter, of the first embodiment of the present invention, with a precursor fault.
Figure 8:
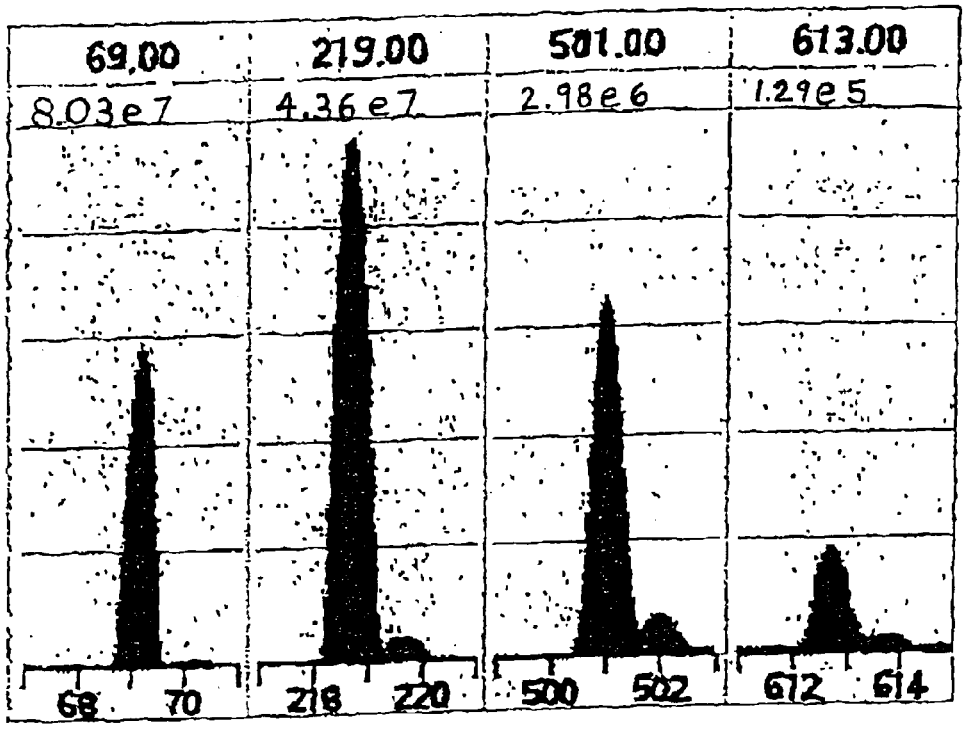
FIG. 8 depicts four mass spectrum fragment graphs of PFTBA for four ions with different mass-to-charge ratios when an ionised sample of PFTBA is analysed using the quadrupole mass filter, of the first embodiment of the present invention, in which a precursor fault has been eliminated.

FIGS. 7 and 8 depict the mass spectrum graphs for four ions of PFTBA with different mass-to-charge ratios; 69 Da, 219 Da, 502 Da and 614 Da. The sample of ionised PFTBA has been analysed using a QMF and apparatus according to the first embodiment of the invention. FIGS. 7 and 8 relate to a QMF when it is first tested after being integrated as part of a mass spectrometer. The mass spectrum graphs of FIG. 7 show that the QMF has a precursor fault. Precursor peaks on the graphs indicate ions have been transmitted at voltages below the nominal voltages. The precursor peak for mass-to-charge ratio 69 Da is partially blended into the main peak. In fact, the QMF has a precursor fault created by mechanical misalignment. One of the y-axis electrode rods has a radial displacement of 6 microns towards the centre of the QMF. The mass spectrum graphs of FIG. 8 relate to the QMF when AC potential differences have been applied to y-axis electrode rods. Since the precursor fault is caused by mechanical misalignment the AC potential differences required to correct the asymmetrical field are proportional to the mass-to-charge ratios of the ions. The graphs in FIG. 8 no longer include a precursor peak because the ions can only travel through the QMF when nominal voltages are applied. The precursor fault has been eliminated and the filtering action has improved.

The operating frequency of the QMF is 832 KHz. The radius of the inscribed circle between the rods is 5.325 mm. The power supplied to the electrode rods when scanning the PFTBA sample for ions of mass 614 Da is 1740V for peak AC voltage and 292V for DC voltage. The distance of separation between the precursor peak and parent peak in the mass spectrum for 614 Da measures approximately one half of an Dalton (Da) unit. The power supply control means includes a 100 Ohm potentiometer and means to manually adjust the AC voltages applied to the y-axis electrode rods via the potentiometer. The potentiometer is adjusted to change the AC potentials at the y-axis electrode rods until the precursor peak on the mass spectrum graph disappears. As the potential difference increases the precursor peaks starts to blend into the parent peak on the mass spectrum graph. The precursor peak entirely disappears when an AC potential difference of approximately 0.24V is applied across the y-axis electrodes. Thus, the precursor fault is eliminated.

Values relating to the mass spectrometer using the apparatus according to first embodiment of the invention are listed below.

BEFORE, WITH PRECURSOR FAULT

| Source | Set | Rdbk |
|---|---|---|
| Electron Energy, eV | 70 | −70 |
| Emission, μA | 200 | 203 |
| Repeller, V | 1.0 | 1.0 |
| Lens 1, V | 50 | −51 |
| Lens 2, V | 0 | 0 |
| Lens 3, V | 300 | −301 |
| Lens 4, V | 100 | −100 |
| Aperture, no units | LARGE | |
| Source Temperature, ° C. | 180 | 180 |
| Filament Current, A | | 4.20 |
| Source Current, μA | | 1629 |

| Pressures | Rdbk |
|---|---|
| Source Vacuum, mb | 4.4e−6 |
| Analyser Vacuum, mb | 1.1e−5 |
| Backing, mb | 1.3e−2 |
| Inlets, mb | 5.3e−3 |

| Mass Spectrometry | Set |
|---|---|
| LM Resolution, no units | 16.6 |
| HM Resolution, no units | 11.2 |
| Ion Energy, eV | 1.8 |
| Ion Energy Ramp, eV/Da | 0.0 |
| Multiplier, V | 300 |

AFTER, WITHOUT PRECURSOR FAULT

| Source | Set | Rdbk |
|---|---|---|
| Electron Energy, eV | 70 | −70 |
| Emission, μA | 200 | 201 |
| Repeller, V | 1.0 | 1.0 |
| Lens 1, V | 50 | −51 |
| Lens 2, V | 0 | −1 |
| Lens 3, V | 300 | −301 |
| Lens 4, V | 100 | −100 |
| Aperture, no units | LARGE | |
| Source Temperature, ° C. | 180 | 180 |
| Filament Current, A | | 4.21 |
| Source Current, μA | | 1600 |

| Pressures | Rdbk |
|---|---|
| Source Vacuum, mb | 7.5e−6 |
| Analyser Vacuum, mb | 4.6e−5 |
| Backing, mb | 4.3e−2 |
| Inlets, mb | 6.2e−3 |

-continued

| Mass Spectrometry | Set |
|---|---|
| LM Resolution, no units | 13.9 |
| HM Resolution, no units | 16.7 |
| Ion Energy, eV | 1.8 |
| Ion Energy Ramp, eV/Da | 0.0 |
| Multiplier, V | 340 |

Figure 9A:
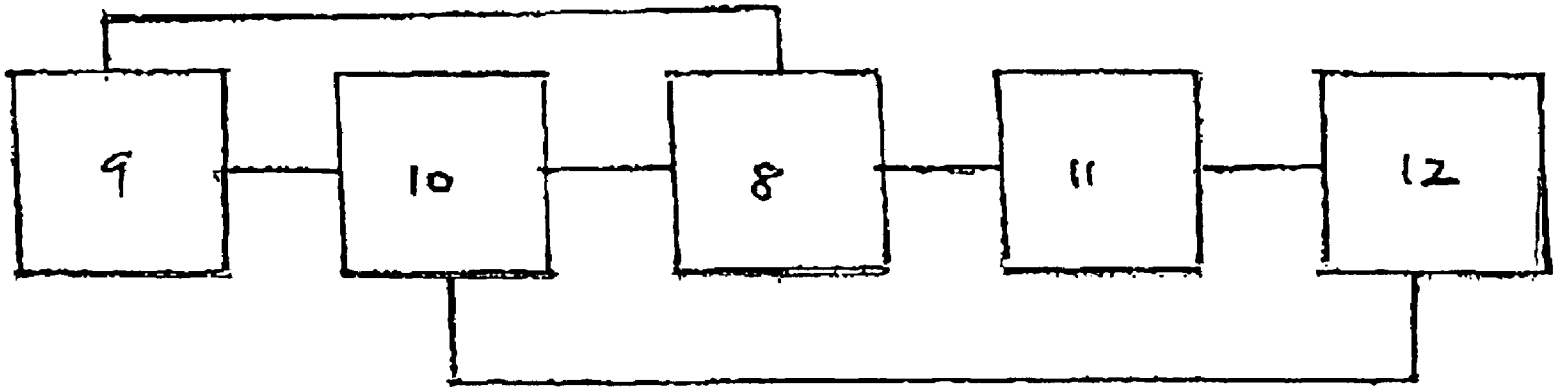
FIG. 9A depicts a simplistic schematic overview of the components of the second embodiment of the invention.
Figure 9B:
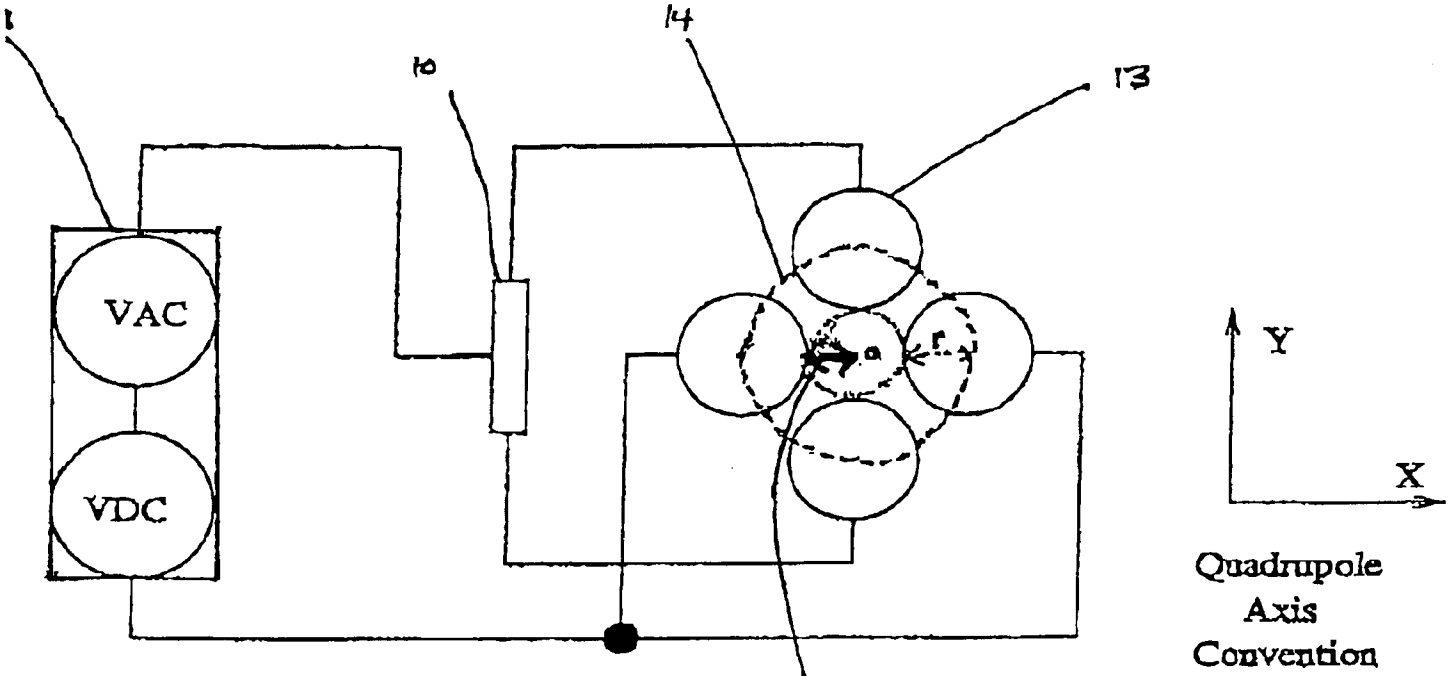
FIG. 9B depicts how the electrode rods are electrically connected to the power supply and power supply control means in the second embodiment of the invention.

FIGS. 9A and 9B depict the second embodiment of the present invention to improve the filtering action of a quadrupole mass filter. FIG. 9A depicts a QMF (8), AC and DC power supply (9), power supply control means (10), detector (11) and processing means (12). FIG. 9B shows how the electrode rods (13) are electrically connected to the power supply and power supply control means.

The QMF comprises four electrode rods (13) held in a square parallel array. The electrode rods are arranged and have the same features as the first embodiment of the present invention.

The electrode rods are connected to an AC and DC power supply (9). As with the first embodiment, the x-axis electrodes are directly connected to the AC and DC power supply. They are electrically connected together so that they have a common power supply. Thus, no potential difference is set-up across the x-axis. The y-axis electrode rods are indirectly connected to the AC and DC power supply via the power supply control means (10). The power supply control means includes means to individually supply power to each y-axis electrode rod. The power supply control means controls the AC voltage such that an AC potential difference can be created across the y-axis. The AC potential difference may be set up by changing the AC potentials at one or both of the electrode rods in the y-axis.

If a y-axis electrode rod is radially displaced towards the centre of the quadrupole mass filter the electric field intensity across the y-axis increases. The imbalance in the resulting electric field may be corrected by decreasing the AC voltage applied to the displaced y-axis electrode rod, or increasing the AC voltage applied to the opposing y-axis electrode rod or changing the AC voltage applied to both rods. Conversely, if a y-axis electrode rod is radially displaced away from the centre of the quadrupole mass filter the electric field intensity across the y-axis decreases. The imbalance in the resulting electrical field may be corrected by increasing the AC voltage applied to the displaced y-axis electrode rod, or decreasing the AC voltage applied to the opposing y-axis electrode rod or changing the AC voltage applied to both rods.

The detector (11) is arranged to detect the transmitted ions as they exit the QMF. The detector and processing means (12) are electrically connected together. The processing means is a personal computer with a display monitor. As explained above, the filtering action may be determined manually from a mass spectrum generated and graphically displayed on the processing means or the filtering action may be determined electronically by the processing means from data direct from the detector or from the mass spectrum.

The processing means work in conjunction with the power supply control means, once a precursor fault has been detected, to reduce the fault by reducing asymmetry in the electrical field. An AC potential difference is applied across the y-axis electrode rods to reduce the precursor fault whenever the QMF is in operation.

The processing means may include means to determine the cause of the precursor fault. Either the processing means or power supply control means include means to electronically calculate the potential difference(s) required to reduce the precursor fault. The processing means or power supply control means may include a memory to store the potential difference value(s).

The power supply control means may include manual or electronic means to control the power supplied to the individual y-axis electrode rods. These means may be limited to controlling the AC voltage applied to one or both of the electrode rods.

The power supply control means also include means to provide ramping control signals to facilitate mass scanning.

The U/V ratio of the DC and AC power supply is controlled to ensure that the QMF operates at a required resolution.

Optionally, the power supply control means may also control the DC voltage applied to the y-axis electrode rods. The power supply control means may control the DC voltage in order to introduce a DC potential difference across the y-axis. A DC potential difference may be applied help to further reduce a precursor fault caused by a surface charge imbalance between the y-axis electrode rods. A DC potential difference maybe set-up by changing the DC potentials at one or both of the electrode rods in the y-axis. A DC potential difference may be applied manually, or calculated and applied electronically in a similar manner to the AC potential difference.

The AC and DC power supply and power supply control means may be adapted to enable each electrode to be supplied power separately. This alternative arrangement is depicted in FIGS. 10A and 10B. This arrangement permits the reduction of a precursor fault when analysing positive ions or negative ions without the need to manipulate the AC and DC power supply. When the QMF analyses positive ions the power supply control means ensure that a positive DC potential is applied to the x-axis electrode rods and a negative DC potential is applied to the y-axis electrode rods.

Conversely, when the QMF analyses negative ions the power supply control means ensure that a negative DC potential is applied to the y-axis electrode rods and a positive DC potential is applied to the y-axis electrode rods.

Figure 11A:
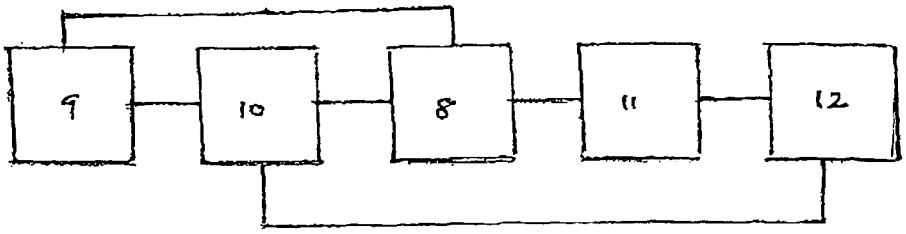
FIG. 11A depicts a simplistic schematic overview of the components of the third embodiment of the invention.
Figure 11B:
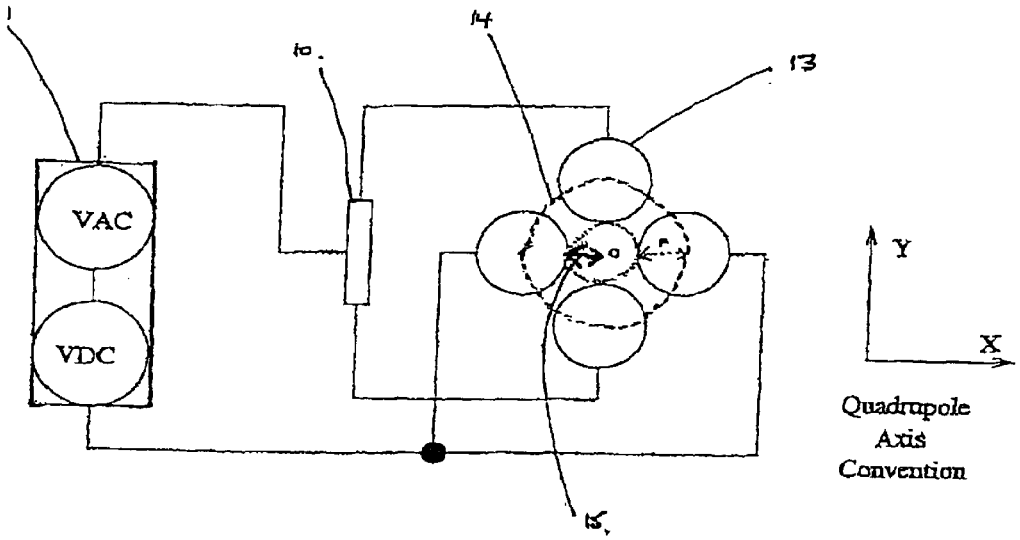
FIG. 11B depicts how the electrode rods are electrically connected to the power supply and power supply control means in the third embodiment of the invention.

FIGS. 11A and 11B depict the third embodiment of the present invention to improve the filtering action of a quadrupole mass filter. FIG. 11A depicts a QMF (8), AC and DC power supply (9), power supply control means (10), detector (11) and processing means (12). FIG. 11B shows how the electrode rods (13) are electrically connected together to the power supply and power supply control means.

The QMF comprises four electrode rods (13) held in a square parallel array. The electrode rods are arranged and have the same features as the first and second embodiments.

The detector (11) is arranged to detect the transmitted ions as they exit the QMF. The detector and processing means (12) are electrically connected together. The processing means is a personal computer with a display monitor. As explained above, the filtering action of the QMF may be determined manually from a mass spectrum generated and graphically displayed on the processing means or the filtering action may be determined electronically by the processing means from data direct from the detector or the from the mass spectrum.

The electrode rods are connected to an AC and DC power supply. As with the first embodiment, the x-axis electrode rods are directly connected to the AC and DC power supply. They are electrically connected so that they have a common power supply. Thus no potential difference is set-up across the x-axis electrode rods. The y-axis electrode rods are indirectly connected to the AC and DC power supply via the power supply control means. The power supply control means include a potential divider and means to individually supply power each y-axis electrode rod so that both an AC and DC potential difference may be applied across the y-axis. The potential divider may apply an AC or DC potential difference by adjusting the respective AC or DC potentials at both electrode rods. The potential divider may include manual or electronic control means to introduce a potential difference. The means to supply power separately to each electrode rod may apply an AC or DC potential difference by adjusting the respective AC and DC potentials at one or both of the electrode rods. The means to supply power separately may include manual or electronic means to introduce a potential difference.

The DC potential difference is applied to further reduce the precursor fault if it has not been entirely eliminated by the AC potential difference. The DC potential difference is able to further reduce the precursor fault if it is due or due in-part to a surface charge imbalance between the y-axis electrode rods.

The processing means may include means to determine the cause of the precursor fault. The processing means or power supply control means may include means to electronically calculate the potential differences required to reduce the precursor fault. The potential difference values may be calculated when the QMF is tested or during operation. The processing means or power supply control means may include to memory to store the potential difference values.

As with the first and second embodiments, the processing means and power supply control means work together to detect and reduce a precursor fault by applying an AC potential difference. If the precursor fault is detected as being only minimised, then the third embodiment allows the processing means and power supply control means to work together to further reduce the precursor fault by applying a DC potential difference.

As with the second embodiment, the third embodiment may also include an alternative arrangement to enable both the x-axis and y-axis electrode in the QMF to be supplied power separately. In this case, the power supply control means further includes means to supply power separately to the x-axis electrode rods. As explained above, this arrangement allows for the analysis of positive and negative ions without having to manipulate the AC and DC power supply.

The preferred features of the invention are applicable to all aspects of the invention and may be used in any combination.

What is claimed is:

1. Apparatus to improve the filtering action of a quadrupole mass filter by reducing a precursor fault caused by an asymmetric electrical field between a pair of opposing electrode rods in a y-axis of the quadrupole mass filter, the apparatus comprising:

processing means for processing detector data to determine the filtering action of the quadrupole mass filter by checking for a precursor fault; and power supply control means to introduce an AC potential difference across the electrode rods in the y-axis, if a precursor fault is detected, in order to reduce asymmetry in the electrical field in the y-axis.

2. Apparatus as claimed in claim 1, wherein the power supply control means comprises a potential divider to introduce an AC potential difference across the electrode rods in the y-axis.

3. Apparatus as claimed in claim 2, wherein the power supply control means comprises means to manually control the potential divider.

4. Apparatus as claimed in claim 2, wherein the power supply control means comprises means to electronically control the potential divider.

5. Apparatus as claimed in claim 1, wherein the power supply control means comprises means to supply power separately to each electrode rod in the y-axis to introduce an AC potential difference across the electrode rods in the y-axis.

6. Apparatus as claimed in claim 5, wherein the power supply control means comprises means to manually control the means to supply power separately to each electrode rod in the y-axis.

7. Apparatus as claimed in claim 5, wherein the power supply control means comprises means to electronically control the means to supply power separately to each electrode rod in the y-axis.

8. Apparatus as claimed in claim 1, wherein the processing means comprises means to determine the cause of the precursor fault.

9. Apparatus as claimed in claim 1, wherein the processing means comprises means to determine the AC potential difference required to reduce asymmetry in the electrical field in the y-axis.

10. Apparatus as claimed in claim 9, when dependent on claim 8, wherein the processing means comprises means to determine the AC potential differences required to reduce asymmetry in the electrical field in the y-axis as the QMF scans across an ion mass-to-charge ratio scale when the precursor fault is due to mechanical misalignment or both mechanical misalignment and surface charge imbalance between the y-axis electrode rods.

11. Apparatus as claimed in claim 9, when dependent on claim 8, wherein the processing means comprises means to determine the AC potential difference required to reduce asymmetry in the electrical field in the y-axis as the QMF scans across an ion mass-to-charge ratio scale when the precursor fault is due to a surface charge imbalance between the y-axis electrode rods.

12. Apparatus, as claimed in claim 1, wherein the power supply control means comprise means to determine the AC potential difference required to reduce asymmetry in the electrical field in the y-axis.

13. Apparatus, as claimed in claim 12, wherein the power supply control means comprises means to determine the AC potential differences required to reduce asymmetry in the electrical field in the y-axis as the QMF scans across an ion mass-to-charge ratio scale when the precursor fault is due to mechanical misalignment or both mechanical misalignment and surface charge imbalance between the y-axis electrode rods.

14. Apparatus as claimed in claim 12, when dependent on claim 8, wherein the power supply control means comprises means to determine the AC potential difference required to reduce asymmetry in the electrical field in the y-axis as the QMF scans across an ion mass-to-charge ratio scale when the precursor fault is due to a surface charge imbalance between the y-axis electrode rods.

15. Apparatus as claimed in claim 1, wherein the power supply control means comprises means to introduce an AC potential difference across the electrode rods in the y-axis to reduce asymmetry in the electrical field in the y-axis whenever the QMF is in operation.

16. Apparatus as claimed in claim 1, wherein the power supply control means additionally comprises means to introduce a DC potential difference across the electrode rods in the y-axis.

17. Apparatus as claimed in claim 16, wherein the means to introduce a DC potential difference comprises means to supply power separately to each electrode rod in the y-axis.

18. Apparatus as claimed in claim 16, wherein the means to introduce a DC potential difference comprises a potential divider.

19. Apparatus as claimed in claim 5, wherein the means to supply power separately are adapted to introduce a DC potential difference across the electrode rods in the y-axis.

20. Apparatus as claimed in claim 5, wherein the power supply control means comprises means to supply power separately to each electrode rod in a pair of opposing electrode rods in an x-axis.

21. A method of improving the filtering action of a quadrupole mass filter by reducing a precursor fault caused by an asymmetric electric field between a pair of opposing electrode in a y-axis, comprising the steps of:

determining the filtering action of the quadrupole mass filter by checking for a precursor fault; and if a precursor fault is detected, introducing an AC potential difference across the electrode rods in the y-axis in order to reduce asymmetry in the electrical field.

22. A method as claimed in claim 21, further comprising the step of introducing an AC potential difference by changing the applied AC voltage at one electrode rod in the y-axis.

23. A method as claimed in claim 21, further comprising the step of introducing an AC potential difference by changing the applied AC voltage at both electrode rods in the y-axis.

24. A method as claimed in claim 22, further comprising the step of determining the cause of the precursor fault.

25. A method as claimed in claim 22, further comprising the step of determining the AC potential difference required to correct asymmetry in the electrical field in the y-axis.

26. A method as claimed in claim 22, further comprising the step of introducing an AC potential difference across the electrode rods in the y-axis whenever the QMF is in operation.

27. A method as claimed in claim 22, further comprising the step of introducing a DC potential difference across the electrode rods in the y-axis.

28. A method as claimed in claim 22, further comprising the step of supplying power separately to each electrode rod in a pair of opposing electrode rods in an x-axis.

* * * * *